United States Patent [19]

Martinek

[11] Patent Number: 4,558,826

[45] Date of Patent: Dec. 17, 1985

[54] HAMMER FOR AUTOMOBILE SHREDDING MILLS

[75] Inventor: John J. Martinek, Andover, Minn.

[73] Assignee: Evans Products Company, Wilmington, Del.

[21] Appl. No.: 639,525

[22] Filed: Aug. 8, 1984

Related U.S. Application Data

[63] Continuation of Ser. No. 397,530, Jul. 12, 1982, abandoned.

[51] Int. Cl.[4] ..... B02C 13/04; B02C 13/28

[52] U.S. Cl. ..... 241/189 R; 241/194; 241/195

[58] Field of Search ..... 241/189 R, 189 A, 194, 241/195, 197

[56] References Cited

U.S. PATENT DOCUMENTS

| | | | |
|---|---|---|---|
| 1,444,990 | 2/1923 | Wauthier | 241/195 |
| 1,647,555 | 11/1927 | Wells . | |
| 1,827,986 | 10/1931 | Iglehart . | |
| 3,727,848 | 4/1973 | Francis | 241/197 X |
| 3,738,586 | 6/1973 | Fabert, Jr. | 241/195 |
| 3,917,179 | 11/1975 | Graf | 241/194 |
| 4,129,262 | 12/1978 | Lowry | 241/197 |
| 4,141,512 | 2/1979 | Francis | 241/194 |
| 4,310,125 | 6/1982 | Novotny | 241/195 |

*Primary Examiner*—Howard N. Goldberg
*Assistant Examiner*—Timothy V. Eley
*Attorney, Agent, or Firm*—Merchant, Gould, Smith, Edell, Welter & Schmidt

[57] ABSTRACT

An improved hammer comprises a hammer body with a substantially bell-shaped profile having a larger end and sides converging to a smaller end with front and back faces that are substantially flat. A large mounting bore extends through the body closer to the smaller end to receive a pivot shaft from which the hammer may pivotally swing. A lifting eye is integrally formed with the hammer body, and includes sides that extend from the sides of the hammer body, converging to a rounded apex.

17 Claims, 6 Drawing Figures

11
12
13
14
15a
15b
16
17
18
19
21
22
23
24
25

HAMMER FOR AUTOMOBILE SHREDDING MILLS

This is a continuation of application Ser. No. 397,530, filed July 12, 1982, now abandoned.

TECHNICAL FIELD

The invention is directed to an improved hammer having particular use in an automobile shredding mill.

BACKGROUND OF THE INVENTION

Shredding mills are used for salvage purposes in converting junked automobiles into fragments that may be used in recycling processes. Automobile shredding mills typically comprise apparatus that rotates relative to a cutter bar at the end of a feeder chute through which the junked automobile is fed. The rotating apparatus conventionally comprises four or six sets of hammers, each set including a plurality of hammers mounted for swinging movement on a common pivot shaft. The pivot shafts are carried between large structural spiders that are mounted on the large central drive shaft. The pivot shafts are equiangularly disposed around the drive shaft, which typically rotates at 720 revolutions per minute. For each revolution, each of the four or six rows of hammers passes by the cutter bar, shearing or shredding the automobile as it is fed along the entry chute.

The rotating sets of hammers are enclosed in a housing that is generally cylindrical in configuration, comprising in part a number of solid liner sections, and also comprising a plurality of discharge grates that are radially oriented and spaced apart to define discharge openings. The fragments resulting from the shredding process are dropped from the grates onto a conveyor.

One of the problems associated with automobile shredding mills is replacement of the hammers, which wear down during the shredding process and require replacement on the order of every twenty days. The individual hammers are relatively heavy, weighing from 225–480 pounds, necessitating the use of lifting equipment in the removal and installation process. The problem is compounded by the fact that the hammers of each set are commonly mounted on a single pivot shaft, requiring all of the hammers to be suspended simultaneously for both removal and installation.

This problem has been dealt with by including a small lifting eye on each hammer suitable for lifting the hammer through the use of a grappling hook or the like. The lifting eye works adequately during installation of new hammers since it is intact at the time of fabrication. However, because the lifting eyes form part of the hammers themselves, they are broken by impact, or worn away quite easily during the shredding process, and as a result there is no structure by which the hammers can be lifted during replacement.

A related problem that leads to the same disadvantageous result is the difficulty in fabricating lifting eyes on hammers. It is quite difficult to cast members such as conventional lifting eyes from hardened alloys without encountering cracks of some type. Where such cracks occur and are immediately perceived during the casting process, the entire hammer must be scrapped, resulting in wasted material and time. If the cracks are not immediately perceived, it is possible for the lifting eye to fragment during the shredding process, again leaving the hammer without any structural means for lifting it out during replacement.

The problems of lifting eye wear and fragmenting become more critical in those shredding mills which use opposed long rolls and short rolls in the rotating apparatus. A "long roll" refers to a set of new hammers having full length. The term "short roll" refers to a set of hammers which have been used for a period of time and have a shorter length by reason of wear.

In mills using both long rolls and short rolls, the partially worn hammers are advantageously used, but they must be installed, reversed, and removed at least twice during their useful life. If the lifting eye wears or fragments at any time prior to the second removal, the hammer cannot be removed with conventional means.

The inability to remove and install or reinstall hammers because of the absence of lifting eyes adds a significant amount of time to the replacement process and increases the downtime of the mill. A typical solution has been to weld new lifting eyes onto old hammers simply to permit their removal. Thus, the problem and its existing solution requires increased downtime, increased expenditure of materials and labor, and a decrease in productivity of the mill. Welding on a hardened alloy increases the risk of hammer failure by cracking. At full speed, such failures are extremely hazardous.

SUMMARY OF THE INVENTION

An improved hammer embodying the inventive principle comprises a hammer body with a substantially bell-shaped profile having a larger end and sides converging to a smaller end with front and back faces that in the preferred embodiment are substantially flat. A large mounting bore extends through the body closer to the smaller end to receive a pivot shaft from which the hammer may pivotally swing.

A lifting eye member is integrally formed with the hammer body, projecting from the first end away from the mounting bore. The lifting eye member includes sides that extend from the sides of the hammer body, converging to a rounded apex. First and second faces are included that taper from the substantially flat faces of the hammer body, also converging at the rounded apex. In the preferred embodiment, the faces are concave.

An aperture is formed through the lifting eye member that is small by comparison to the mounting bore to define a lifting eye. In the preferred embodiment, the aperture is spaced from the rounded apex and the tapered sides by a constant amount that approaches the diameter of the aperture itself.

The transverse or face-to-face dimension of the lifting eye member is smallest at the rounded apex, and this smallest transverse dimension is at least about $\frac{1}{3}$ the minimum transverse dimension of the hammer body.

All of the surfaces of the hammer body and lifting eye member are radiused to avoid stress cracks during the casting process as well as to help eliminate chipping and breaking along the edges.

Preferably, the improved hammer is cast from martensitic low alloy chrome molybdenum steel.

As constructed, the improved hammer includes a lifting eye that will not crack during the foundry process, and will not wear away during its useful life in the shredding mill. This is true even though the improved hammer is first used in a long roll and thereafter installed for a further period of time in a short roll.

Further, by reason of the inventive construction, it has been found that duration of the improved hammer is on the order of thirty percent greater than prior art hammers, thus enabling a mill using the improved hammers to handle more tonnage over a greater period of time. Because of greater duration, coupled with greater ease in installing new sets and replacing old ones, mill downtime is also held to a minimum.

DETAILED DESCRIPTION OF THE INVENTION

Figures 1, 2:
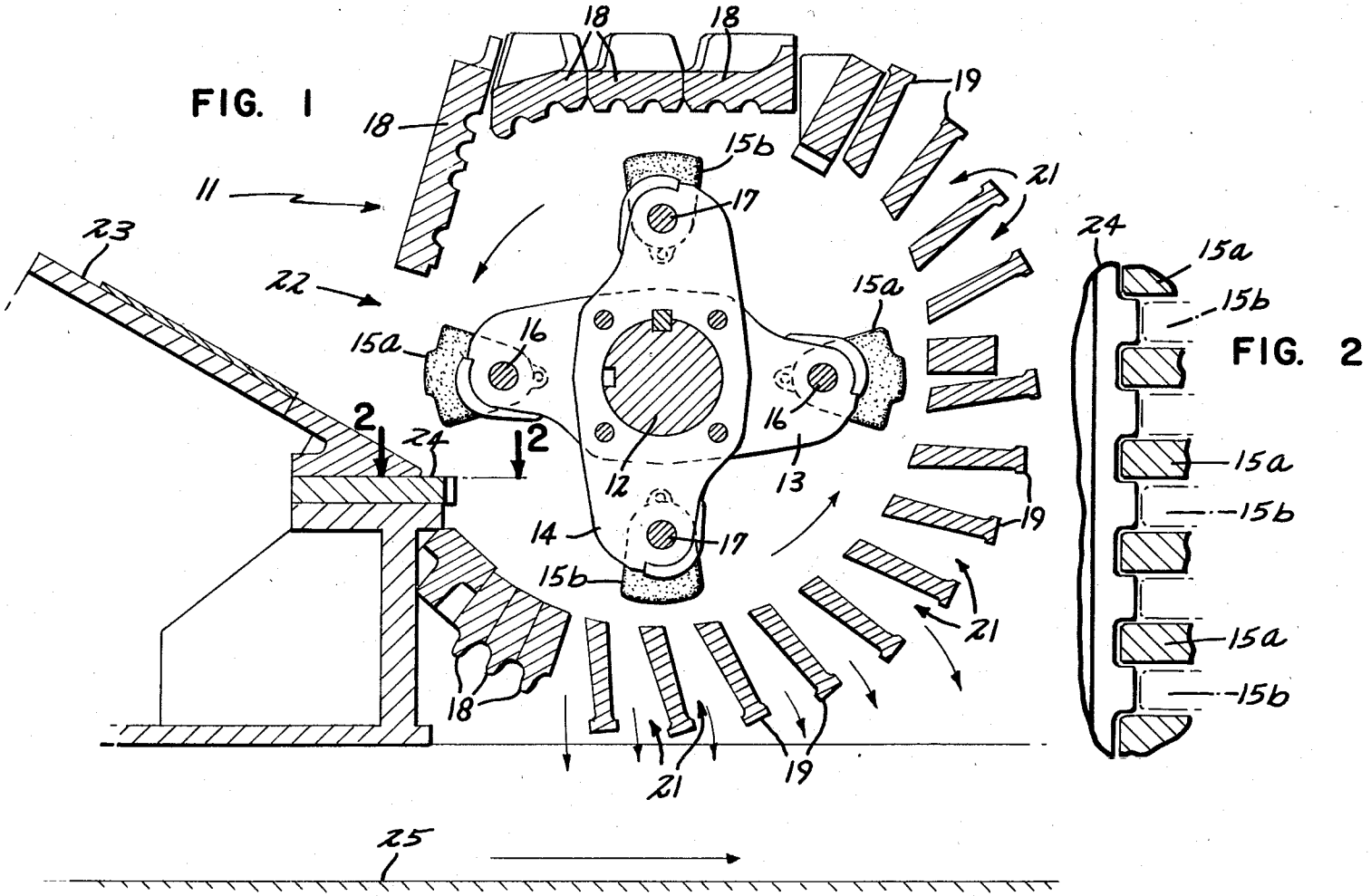
FIG. 1 is a somewhat schematic sectional representation of an automobile shredding mill in which the inventive hammer may be used.
FIG. 2 is a fragmentary sectional view of the shredding mill taken along the line 2—2 of FIG. 1, showing a plurality of spaced hammers relative to the mill cutter bar.
Figure 3:
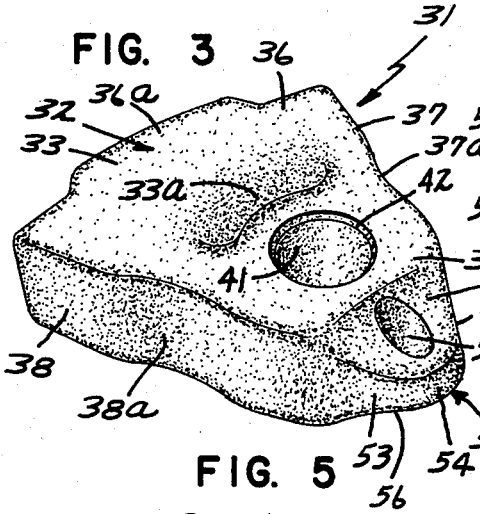
FIG. 3 is a first perspective view of an improved hammer embodying the invention as viewed from the upper end and one face and one side thereof.
Figure 4:
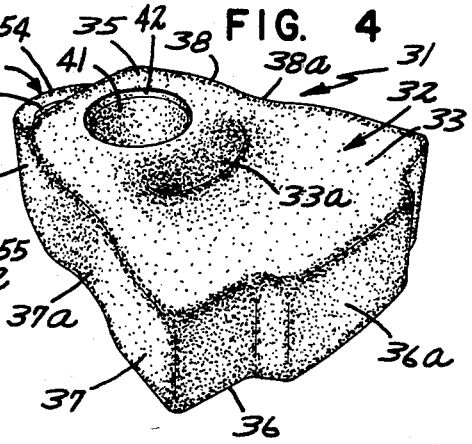
FIG. 4 is a second perspective view of the improved hammer as viewed from the bottom end and one face and one side thereof.

With initial reference to FIG. 1, an automobile shredding mill is represented generally by the numeral 11. In this somewhat schematic representation, the shredding mill 11 is shown to comprise a large, elongated shaft 12 that is rotated at a substantially high velocity (e.g., 720 revolutions per minute) by a drive motor not shown. A pair of spiders 13, 14 are keyed to the shaft 12 for rotation therewith. The spider 13 is adapted to receive two sets of hammers 15*a* which are respectively carried on pivot shafts 16. As an example, each of the pivot shafts 16 may carry eight of the hammers 15*a* in parallel, spaced relation in such a manner that the hammers 15*a* may pivot or swing about the shaft 16.

Pluralities of hammers 15*b* are respectively mounted on pivot shafts 17 at opposite ends of the spider 14. The hammers 15*b* are also mounted in parallel, spaced relation for pivotal swinging movement, but their circumferential paths of travel are staggered relative to those of the hammers 15*a* as will become apparent below.

The rotating structure of the shredding mill 11 is encased by liner sections of different configuration but bearing the same reference numeral 18, and a plurality of discharge grates 19 which extend generally radially outward and are spaced apart to define discharge openings 21 therebetween.

An opening 22 through which automobiles are fed is defined between one of the liner sections 18 and a feeder chute 23. Disposed at the extreme inner end of the chute 23 is a cutter bar 24 the leading edge of which is shown in detail in FIG. 2.

As will be apparent in FIG. 1, the four sets of hammers 15*a*, 15*b* pass relative to the cutter bar 24, shearing or shredding the automobile as it is fed along the feeder chute 23. In this regard, and as will be seen in FIG. 1, the hammers 15*a* have a slightly greater radial dimension than those of the hammers 15*b* by virtue of a stepped projection along the outer edge thereof. This stepped projection wears away after a period of operation, and when this occurs the worn hammer is replaced and at the same time it is moved into one of the sets of hammers 15*b*. This increases the wear life of the hammers and avoids discarding of a hammer when it still has a substantial mass of metal remaining. In this configuration, the two sets of opposed hammers 15*a* are referred to as "long rolls", and the two sets of opposed hammers 15*b* are referred to as "short rolls".

Because of the difference in radial dimension of the hammers 15*a*, 15*b*, the leading edge of the cutter bar 24 is stepped or "castled" as shown in FIG. 2. This enables each of the hammers 15*a*, 15*b* to pass by the cutter bar 24 with essentially the same spacing, thus providing for uniform shearing or shredding across the entire edge of cutter bar 24.

As shown in FIG. 1, a conveyor 25 transports the shredded material away after it has left the mill 11 through the various discharge openings 21.

A hammer embodying the inventive principles is shown in detail in FIGS. 3–6 and bears the general reference numeral 31. Hammer 31 comprises a body 32 having a substantially bell-shaped profile defined by opposed, identical faces 33, 34, a smaller upper end 35, a larger or wider lower end 36, and identical tapered sides 37, 38. Body 32 is symmetrical about a longitudinal axis 39 both in the front or profile elevation of FIG. 5 as well as the side elevation of FIG. 6.

Figure 6:
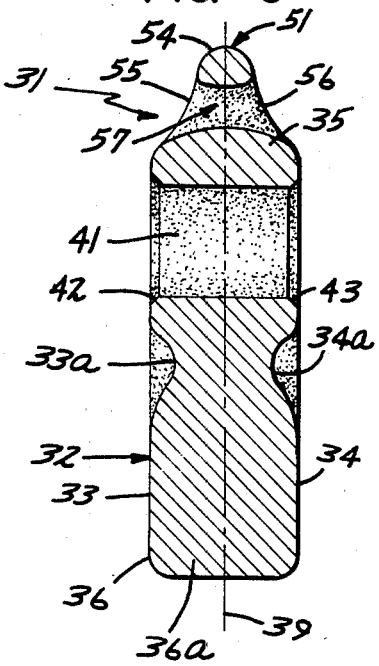
FIG. 6 is a sectional view of the improved hammer as taken along the line 6—6 of FIG. 5.

In the preferred embodiment, the opposed faces 33, 34 are substantially parallel so that the body 32 has a substantially uniform thickness as best shown in FIG. 6. However, kidney-shaped depressions or recesses 33*a*, 34*a* are respectively formed in the mid area of each of the sides 33, 34 to lighten the weight of the hammer 31 without detracting from its swing weight at the enlarged end 36.

A large mounting bore 41 is formed through the body 32, extending perpendicular to and through the faces 33, 34. The diameter of mounting bore 41 is chosen to receive one of the pivot shafts 16, 17 so that the hammer 31 can swing freely during rotation. As best shown in FIG. 6, circumferential chamfers 42, 43 are respectively formed in the faces 33, 34 around the mounting bore 41. These chamfered surfaces 42, 43 assist in guiding the pivot shafts 16, 17 into the bore 41, as well as helping to avoid stress cracks during the casting process.

The bore 41 is positioned nearer the smaller end 35 to permit the hammer 31 to have a substantial swing weight as it is rotated within the mill. In the preferred embodiment, and as best shown in FIG. 6, the distance between the top of mounting bore 41 and the top surface of upper end 35 approximates one-half the diameter of the bore 41 (i.e., the radius of the bore 41).

The larger end 36 has a stepped flat projection 36*a* as discussed above.

The sides 37, 38 are formed with shallow concave recesses 37*a*, 38*a*, respectively in the preferred embodiment.

Figure 5:
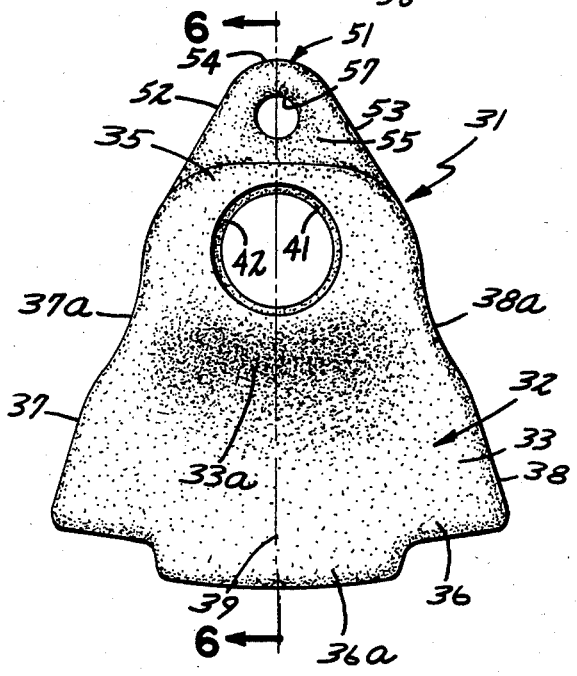
FIG. 5 is a view in side elevation of the improved hammer.

In the preferred embodiment, and as best shown in FIGS. 5 and 6, all of the edges between surfaces are radiused. This not only avoids sharp, angular edges, which are much more subject to chipping and cracking during the shredding process, but also substantially eliminates the stress cracks that arise during the casting process and which are capable of causing the body 32 to fail prematurely. The loss of all or any significant part of one of the hammers 31 during the shredding process gives rise to a balance problem which may range from moderate to severe, and in worse cases requires downtime of the mill 11 while the defective hammer is replaced and any resulting mill damage is repaired.

Projecting from the upper end 35 is a lifting eye member 51. The lifting eye member 51 is integrally cast with the hammer body 32 to avoid any possible separation during installation, operation or removal of the hammer 31.

Lifting eye member 51 comprises first and second tapered sides 52, 53 that are substantially flat in the preferred embodiment, extending from the sides 37, 38 of body 32 and converging at a rounded apex 54.

Lifting eye member 51 further comprises opposed faces 55, 56 that converge from the faces 33, 34 and terminate at the rounded apex 54. In the preferred embodiment, the faces 55, 56 are concave as best shown in FIG. 6.

A lifting aperture 57 which is small relative to the mounting bore 41, extends transversely through the lifting eye member 51. Because of the concavity of the sides 55, 56, the aperture 57 appears somewhat eliptical in the perspective view of FIG. 3, although in the preferred embodiment it is a circular bore as shown in FIG. 5. As best shown in FIG. 6, the surfaces surrounding the aperture 57 are rounded significantly for the reasons stated above.

The lifting eye member 51 is specifically constructed to prevent breakage or any degree of significant wear during operation of the shredding mill 11. To this end, its minimum transverse dimension, which occurs at the rounded apex (FIG. 6), is at least about $\frac{1}{3}$ the minimum transverse dimension or thickness of the hammer body 32 (the dimension between faces 33, 34). Further, in the preferred embodiment, the aperture 57 is spaced from the rounded apex 54 by an amount which approximates the diameter of the aperture 57 itself. This dimension is also the minimum distance between the aperture and the tapered sides 52, 53, as best shown in FIG. 5. As a result, the heaviness of the lifting eye member 51, together with the size and positioning of the aperture 57, provide a lifting structure that will not wear significantly or crack during fabrication or mill operation. Consequently, when the hammer 31 becomes worn and requires reversing of the hammer to wear both sides, 37 and 38, and remounting in the short roll or replacement, the lifting eye member 51 remains and permits the hammer 31 to be lifted from the mill through the use of a grappling hook, crane or the like.

While the invention is not limited to the specific configuration shown in FIGS. 3–6, a consideration of some of the dimensional parameters of the preferred embodiment is useful in relating the size of the lifting eye member 51 to the hammer body 32.

Hammer body 32 has a maximum thickness, or transverse dimension between faces 33, 34, of $5\frac{1}{4}$ inches. The maximum width of the larger end 36, as measured from the lowest point on the sides 37, 38, is $16\frac{1}{2}$ inches. The overall height or maximum axial dimension of the body 32 is approximately $18\frac{5}{8}$ inches.

The mounting bore is approximately $4\frac{1}{8}$ inches in diameter, and its center is 11-13/16 inches from the extreme bottom of the stepped projection 36*a*. The dimension between the center of the rounded top 35 and the top of the mounting bore 41 is two inches.

The minimum axial dimension of the lifting eye 51, as measured from the center of the rounded top 35 to the top of the rounded apex 54, is $2\frac{3}{4}$ inches. The aperture 57 has a diameter of $1\frac{1}{2}$ inches. The aperture 57 has a minimum distance of $1\frac{1}{4}$ inches from the extreme top of apex 54 as well as the sides 52, 53. This dimension of course increases as the sides 52, 53 diverge from the aperture 57.

The minimum thickness of lifting eye member 51, which is measured at the top of aperture 57 at the beginning of the apex 54, is two inches, which is more than $\frac{1}{3}$ the thickness of the hammer body 32.

The hammer 31 is preferably made from low alloy chrome molybdenum steel quenched to produce a martensitic structure to obtain the desired degree of hardness to reduce wear.

The improved hammers 31 are installed in either of the long rolls by suspending the proper number of hammers between the opposed spiders 13 and passing the pivot shaft 16 through the mounting openings 41. Suspension of an entire row of hammers 31 is typically accomplished with an elongated bar with a plurality of chains which respectively pass through the individual lifting eye members 51. With the hammers spaced apart as shown in FIG. 2, spacers (not shown) are, in some applications, substituted for hammers, and such spacers must also be suspended prior to insertion of the pivot shaft 16.

The fact that all of the surfaces of the improved hammer 51 are rounded or radiused avoids the problem of stress cracking during the casting process, which cracking otherwise results in scrapping of the hammer prior to installation, or fragmenting of the hammer prematurely after installation.

Construction of the lifting eye member 51 as described above eliminates any possibility of the lifting eye wearing away, thus insuring that means will be provided for removal of the hammer after it has become worn. With the hammers 51 made in this manner, removal for replacement purposes is simply the reversal of installation, securing chains or other grappling hooks to the respective hammers and removing the pivot shaft. The stronger lifting eye members 51 eliminate any possibility of wearing or breaking away, and avoid the problem associated with prior art structures of welding or otherwise connecting new eyes to the hammer prior to replacement.

What is claimed is:

1. An improved hammer casting for a shredding mill in which pluralities of hammers are swingably mounted on rotated shafts, the improved hammer casting comprising:

a hammer body cast with a substantially bell-shaped profile defined by first and second faces, first and second ends and first and second sides, the second ends being wider than the first end, and the first and second sides being tapered and interconnecting the first and second ends, the body having a transverse dimension defined by the distance between the first and second faces;

a mounting bore extending transversely through said body from the first face to the second face, the nounting bore having a predetermined diameter and being disposed from the first end a distance aaproximating $\frac{1}{2}$ of said predetermined diameter, the mounting bore adapted to receive a pivot shaft to mount the hammer body with said second end swingable to engage and shred material fed to the mill;

and a lifting eye member integrally cast with the hammer body and projecting from said first end away from the mounting bore, the lifting eye member comprising first and second sides that extend in tapered fashion from the first and second sides of the hammer body, converging at an apex;

first and second faces that extend in tapered fashion from the first and second faces of the hammer body, converging at said apex;

an aperture formed through the lifting eye member that is smaller by comparison than the mounting bore to define a lifting eye;

the lifting eye having a transverse dimension defined by the distance between its first and second faces, and a smallest transverse dimension proximate the apex, said smallest transverse dimension being at least about $\frac{1}{3}$ the minimum transverse dimension of the hammer body.

2. The hammer defined by claim 1, wherein the first and second faces of the hammer body are substantially flat and the hammer body has a substantially uniform thickness.

3. The hammer defined by claim 2, wherein the hammer body and lifting eye member are substantially solid.

4. The hammer defined by claim 1, wherein the hammer body and lifting eye member have a predetermined longitudinal axis of symmetry.

5. The hammer defined by claim 4, wherein the mounting bore is perpendicular to said axis.

6. The hammer defined by claim 4, wherein the aperture of the lifting eye member is perpendicular to said axis.

7. The hammer defined by claim 1, in which edges respectively adjoin the first and second faces, ends and sides of the hammer body, each of said edges being radiused.

8. The hammer defined by claim 1, wherein the aperture of said lifting eye member is substantially circular.

9. The hammer defined by claim 8, wherein the aperture of said lifting eye member is spaced from said rounded apex by an amount that approaches its diameter.

10. The hammer defined by claim 9, wherein the aperture is spaced from the first and second sides of the lifting eye member by at least as much as it is spaced from the rounded apex.

11. The hammer defined by claim 1, which is cast from martensitic low alloy chrome molybdenum steel.

12. The hammer defined by claim 1, wherein the first and second sides of said lifting eye member converge at a rounded apex.

13. An improved hammer casting for a shredding mill in which pluralities of hammers are swingably mounted on rotated shafts, the improved hammer comprising:

a hammer body cast with a substantially bell-shaped profile defined by first and second faces, first and second ends and first and second sides, the second end being wider than the first end, and the first and second sides being tapered and interconnecting the first and second ends, the first and second faces being substantially flat and defining a substantially uniform transverse dimension therebetween, and edges defined by the adjoining first and second faces, first and second ends and first and second sides, said edges being radiused;

a mounting bore extending transversely through said body from the first face to the second face and substantially perpendicular thereto, the mounting bore having a predetermined diameter and being disposed from the first end a distance approximating $\frac{1}{2}$ of said predetermined diameter, the mounting bore adapted to receive a pivot shaft to mount the hammer body with said second end swingable to engage and shred material fed to the mill;

and a lifting eye member integrally cast with the hammer body and projecting from said first end away from the mounting bore, the lifting eye member comprising first and second sides that extend in tapered fashion from the first and second sides of the hammer body, converging at a rounded apex;

first and second faces that extend in tapered fashion from the first and second faces of the hammer body, also converging at said rounded apex;

an aperture formed through the lifting eye member that is smaller relative than the mounting bore to define a lifting eye, said aperture being circular and spaced from the rounded apex by an amount that approaches its diameter;

the lifting eye having a transverse dimension defined by the distance between its first and second faces and a smallest transverse dimension proximate the rounded apex, said smallest transverse dimension being at least about $\frac{1}{3}$ the minimum transverse dimension of the hammer body.

14. The hammer defined by claim 13, wherein the hammer body and lifting eye member have a predetermined longitudinal axis of symmetry.

15. The hammer defined by claim 13, wherein the aperture is spaced from the first and second sides of the lifting eye member by at least as much as it is spaced from the rounded apex.

16. The hammer defined by claim 13, which is cast from martensitic low alloy chrome molybdenum steel.

17. An improved hammer casting for a shredding mill in which pluralities of hammers are swingably mounted on rotated shafts, the improved hammer casting comprising:

a hammer body cast with a substantially bell-shaped profile defined by first and second faces, first and second ends and first and second sides, the second end being wider than the first end, and the first and second sides being tapered and interconnecting the first and second ends, the body having a transverse dimension defined by the distance between the first and second faces;

a mounting bore extending transversely through said body from the first face to the second face, the mounting bore having a predetermined diameter and being disposed from the first end a distance approximating $\frac{1}{2}$ of said predetermined diameter, the mounting bore adapted to receive a pivot shaft to mount the hammer body with said second end swingable to engage and shred material fed to the mill;

and a lifting eye member integrally cast with the hammer body and projecting from said first end away from the mounting bore, the lifting eye member comprising first and second sides that extend in tapered fashion from the first and second sides of the hammer body, converging at an apex;

first and second faces that extend in tapered fashion from the first and second faces of the hammer body, converging at said apex, said first and second faces being concave;

an aperture formed through the lifting eye member that is small by comparison to the mounting bore to define a lifting eye;

the lifting eye having a transverse dimension defined by the distance between its first and second faces, and a smallest transverse dimension proximate the apex, said smallest transverse dimension being at least about $\frac{1}{3}$ the minimum transverse dimension of the hammer body.

* * * * *

UNITED STATES PATENT AND TRADEMARK OFFICE

CERTIFICATE OF CORRECTION

PATENT NO. : 4,558,826

DATED : December 17, 1985

INVENTOR(S) : John J. Martinek

It is certified that error appears in the above-identified patent and that said Letters Patent is hereby corrected as shown below:

Column 8, line 12, delete the word "relative".

Column 8, line 64, change the word "small" to --smaller-- and change the word "to" to --than--.

Signed and Sealed this

*Sixth* Day of *May 1986*

[SEAL]

*Attest:*

DONALD J. QUIGG

*Attesting Officer*

*Commissioner of Patents and Trademarks*